US007476790B2

(12) United States Patent
Breedlove et al.

(10) Patent No.: US 7,476,790 B2
(45) Date of Patent: Jan. 13, 2009

(54) MUSICAL INSTRUMENT NECK JOINT

(75) Inventors: Larry Breedlove, Bonita, CA (US); Edward Granero, San Diego, CA (US)

(73) Assignee: Taylor-Listug, Inc., El Cajon, CA (US)

( * ) Notice: Subject to any disclaimer, the term of this patent is extended or adjusted under 35 U.S.C. 154(b) by 0 days.

(21) Appl. No.: 11/584,201

(22) Filed: Oct. 20, 2006

(65) Prior Publication Data

US 2008/0092716 A1 Apr. 24, 2008

(51) Int. Cl.
*G10D 3/00* (2006.01)

(52) U.S. Cl. ..... 84/293

(58) Field of Classification Search ..... 84/293, 84/267, 290

See application file for complete search history.

(56) References Cited

U.S. PATENT DOCUMENTS 2,497,116 A 2/1950 Dopyera
3,550,496 A * 12/1970 Fender ..... 84/293
4,793,236 A 12/1988 McGuire et al.
4,939,970 A 7/1990 Hoshino et al.
5,390,578 A 2/1995 Raymer
5,452,637 A * 9/1995 DeCola ..... 84/291
5,786,539 A 7/1998 Steinberger
5,886,272 A 3/1999 Regenberg
6,265,648 B1 7/2001 Steinberger
6,831,218 B2 12/2004 Steinberger
2007/0107579 A1 * 5/2007 Babicz ..... 84/293

* cited by examiner

*Primary Examiner*—Kimberly R Lockett
(74) *Attorney, Agent, or Firm*—Peter K. Hahn; Luce, Forward, Hamilton & Scripps, LLP

(57) ABSTRACT

The present invention provides a removable and adjustable neck joint between a neck and a body of a musical instrument. The neck includes a contoured mounting portion that engages a pocket included in the body. The mounting portion and pocket include engagement features that provide contact between the mounting portion and pocket.

20 Claims, 9 Drawing Sheets

MUSICAL INSTRUMENT NECK JOINT

FIELD OF THE INVENTION

The present invention is directed to a musical instrument, and more particularly a musical instrument that includes a removable coupling between a body portion and a neck portion of the instrument.

BACKGROUND OF THE INVENTION

Stringed musical instruments such as guitars, basses, violins and cellos typically include a neck coupled to a body at a neck joint and strings strung between the neck and the body. The body may take various shapes depending on the desired acoustic and structural characteristics. For example, acoustic instruments generally include hollow bodies, while electric instruments oftentimes include solid or semi-solid bodies that provide support for various electronics, still further some instruments may be hybrid acoustic and electric and may have solid and hollow body portions.

The neck is generally a narrow elongate member. That configuration results from the functional requirements of the neck. For example, the neck must be long enough to suspend the strings over a significant distance. In addition, the circumference of the neck must be sized so that a musician is able to wrap their hand at least partially around the neck to manipulate the strings. Because of the configuration, necks are often susceptible to warping and disfiguring both during manufacture and over time. As a result, it is desirable to include a neck joint that is adjustable or allows the neck to be replaced.

Various attempts have been made to provide a neck joint for a stringed musical instrument that may be adjusted and/or disassembled. For example, U.S. Pat. No. 2,497,116 to Dopyera teaches a musical instrument, such as a guitar, having a neck attached to a body. Specifically, the neck portion includes an extension that protrudes perpendicularly from the neck into a well included in the body. A pair of fasteners is provided that couple the extension to the body and adjust the angle of the neck with respect to the body by manipulating the position of the extension within the well.

Such a system presents multiple disadvantages. One drawback is that the attachment between the neck and body portions requires the use of more than a single fastener. Another drawback of the system is that both fasteners are oriented substantially parallel to the guitar soundboard. Because of that orientation, it is difficult and problematic to insert the screws through the sidewall of the guitar, particularly since the screw holes are disposed directly underneath the neck. In addition adjustment of the screws is cumbersome. Furthermore, such an arrangement alters the aesthetics of the guitar.

In another example, shown in U.S. Pat. No. 5,886,272 to Regenberg, a neck joint is formed between a protruding trapezoidal heel of a neck that extends into a matching trapezoidal pocket in a guitar body. The close fit of the trapezoidal pocket and heel in addition to the walls of the pocket on every side of the heel limit movement of the heel. A plurality of fasteners secures the neck to the body.

A drawback of the guitar is that entire surfaces of the heel and/or the pocket must be carefully shaped and held to tight tolerances to achieve a desired fit which significantly increases the effort required to produce a proper fit. In addition, because it is difficult to achieve such a fit between the trapezoidal parts it is likely that multiple fasteners would be required to allow the use of looser tolerances. In fact that reference even recognizes that the length of the pocket should be as long as possible to reduce possible alignment error. However, such a requirement may have a direct deleterious effect on the aesthetics and structure of the body because it requires the engagement between the neck and body to be as long as possible to improve the fit.

In view of the above, there exists a need for a musical instrument featuring an uncomplicated and easy to manufacture adjustable attachment between the neck and body portions that creates a reliable fit.

SUMMARY OF THE INVENTION

In view of the foregoing, it is an object of the present invention to provide a musical instrument featuring an uncomplicated attachment between the neck and body.

It is another object of the invention to provide a musical instrument neckjoint comprising a locking contoured engagement between a contoured pocket in the body and a corresponding contoured projection, or tongue, of the neck.

It is a further object of the invention to provide a musical instrument featuring an attachment between the neck and body that requires the use of only a single fastener.

It is a still further object of the invention to provide a musical instrument neck joint that allows easy adjustment of the neck relative to the body during assembly.

It is a still further object of the invention to provide a musical instrument that includes a neck joint that utilizes a single fastener that passes through the body and into the neck at an angle substantially normal to the musical instrument soundboard, such that insertion and adjustment of the screw is straightforward and expedient.

One aspect of the invention involves a musical instrument neck joint, comprising a body including a recessed area comprising a contoured pocket and a neck including a contoured mounting portion, such as a tongue or paddle, adapted to be received by the contoured pocket. The tongue and pocket are contoured so that they are complimentary and so that there are a plurality of triangulated points of contact between the tongue and pocket.

The engagement of the contoured tongue and pocket results prevents relative movement between the tongue and body. The neck and body are held together, with the tongue received in the pocket, using a single fastener. In an aspect, the single fastener is a screw that passes through the body portion and into the neck, such that the screw is disposed substantially perpendicular to a soundboard of the musical instrument.

In the preferred embodiment of the invention, the pocket includes a pair of sidewalls and an end wall, each of which includes at least one recess or projection configured to mate with a complimentary projection or recess of the tongue. In an embodiment, the sidewalls of the pocket include a pair of recesses and the end wall includes a projection. The tongue of the neck includes a pair of sidewalls that include projections and an end wall that includes a recess. A single fastener extends through the body and into the neck. The body and neck are configured so that engagement of the fastener ensures engagement of the projection in the end wall of the pocket with into the recess in the end wall of the tongue.

In another aspect of the invention the musical instrument neck joint includes a spacer, or shim, interposed between the neck and body. According to the preferred embodiment, the contoured pocket includes a spacer well. The spacer is partially disposed within the spacer well so that it is interposed between the body and neck and so that it contacts both the neck and the body. As a result, the spacer dimensions may be selected to provide a desired orientation between the neck and the body.

The fastener is preferably a screw that passes through an aperture in the body and into a threaded insert in the neck. The aperture is disposed within an area of increased thickness of the body portion that also includes the contoured pocket. In another aspect of the present invention, the fastener is used in combination with an insert that is sunk into the body so that the insert is substantially flush with a bottom surface of the musical instrument.

These and other features and advantages of the present invention will be appreciated from review of the following detailed description of the invention, along with the accompanying figures in which like reference numerals refer to like parts throughout.

DETAILED DESCRIPTION

Figure 1:
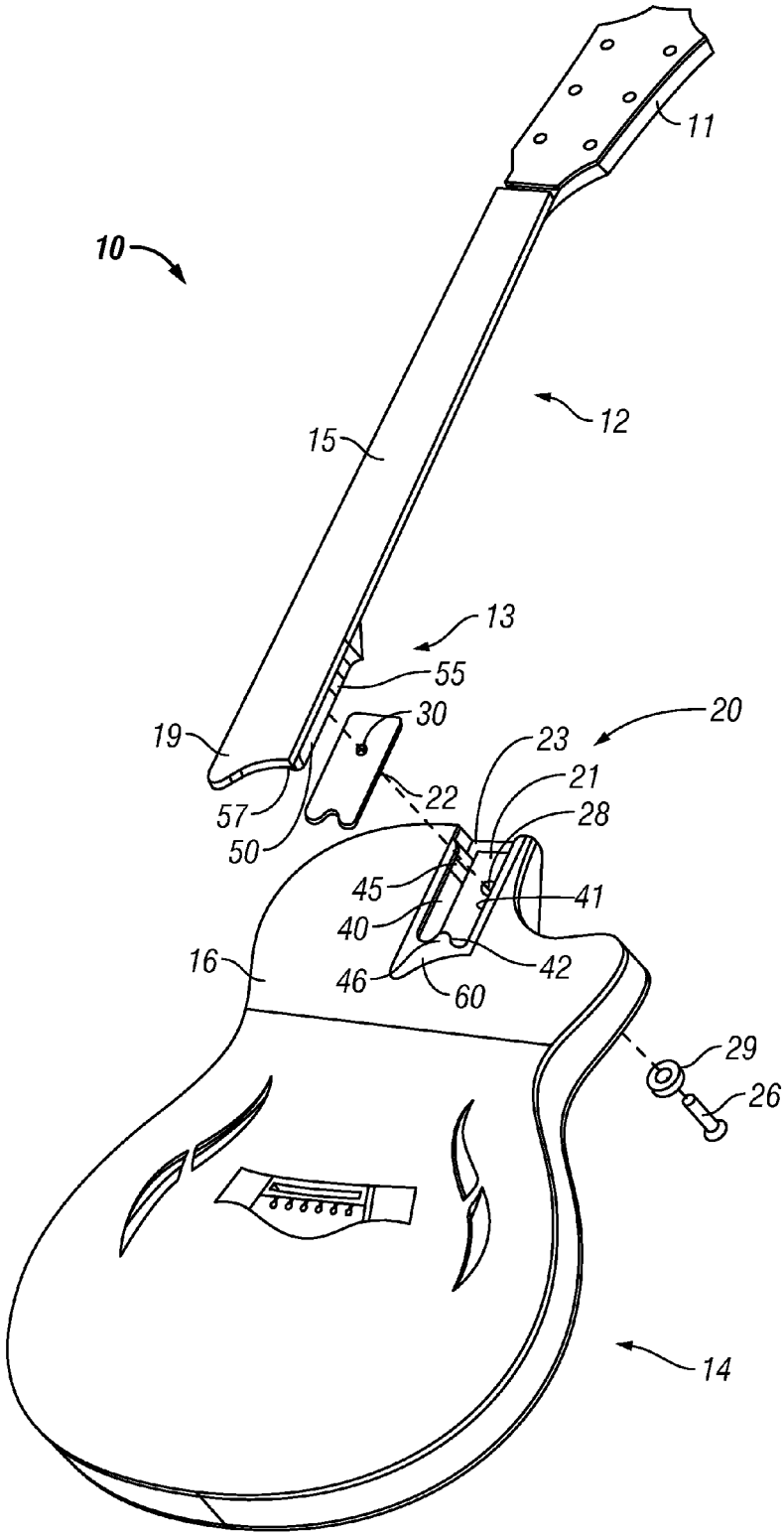
FIG. 1 is an exploded perspective view of a musical instrument including a removable coupling between a neck and body, in accordance with the principles of the present invention.
Figure 2:
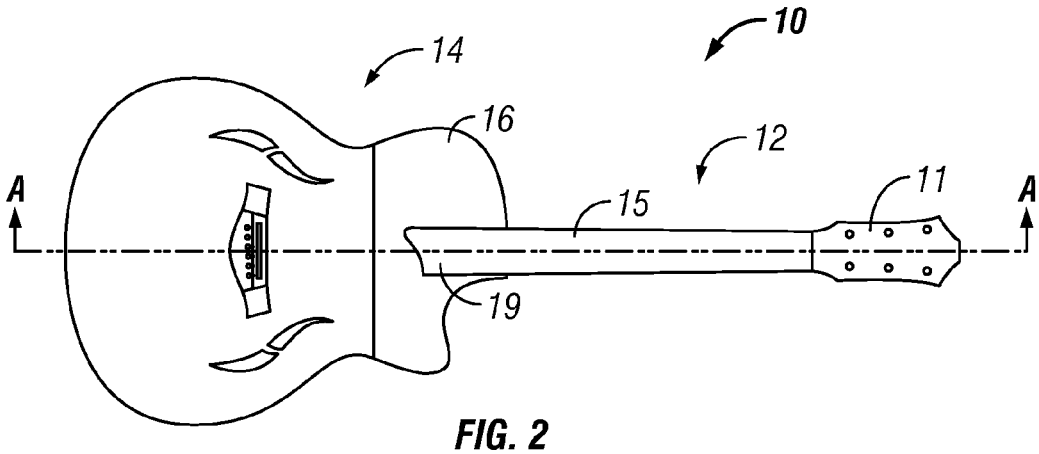
FIG. 2 is a front view of the musical instrument of FIG. 1.

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

Generally, musical instrument 10 includes a neck 12 that is attached to a body 14. In particular, neck 12 is formed with a mounting portion (i.e., tongue 13) which is inserted into a pocket 20 included in body 14. As will be described in greater detail below, tongue 13 and pocket 20 are shaped to include discrete engagement features that provide contact between tongue 13 and pocket 20 at those discrete features. In the preferred embodiment, three engagement features provide triangulated contact between tongue 13 and pocket 20 so that a single fastener may be used to couple neck 12 and body 14. Providing discrete engagement features creates a fit between neck 12 and body 14 that is easy to manufacture.

Referring to FIGS. 1-4, a musical instrument 10 comprises peghead 11, neck 12 and body 14. Musical instrument 10 is depicted with the neck portion 12 removed from the body portion 14, thereby revealing a pocket 20 comprising a locking contoured pocket and an aperture 28 for the passage of a fastener 26 for connecting neck 12 and body 14.

Specifically, pocket 20 is dimensioned to receive tongue 13 of neck 12. In this manner, tongue 13 and pocket 20 are adapted to connect, or mate, together like pieces of a puzzle. In particular, tongue 13 has an outer perimeter that has a shape that corresponds to the shape of the perimeter of pocket 20. Pocket 20 also includes a spacer well 21 that is configured to receive one or more spacers 22, or shims, for adjusting the orientation of neck 12 with respect to body 14.

Neck 12 includes a fingerboard 15 that is coupled to an upper surface of neck 12. Fingerboard 15 includes a plurality of frets 17 located at spaced intervals. A tail portion 19 of fingerboard 15 extends over body 14, part of which is received by a recess in a soundboard 16 of body 14 so that the orientation of neck 12 with respect to body 14 may be adjusted without affecting the aesthetics of instrument 10.

Figure 3:
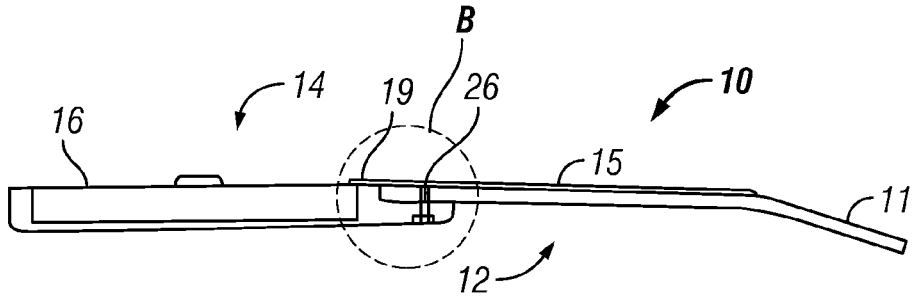
FIG. 3 is a cross-sectional view of the musical instrument of FIG. 1 taken along line A-A.
Figure 4:
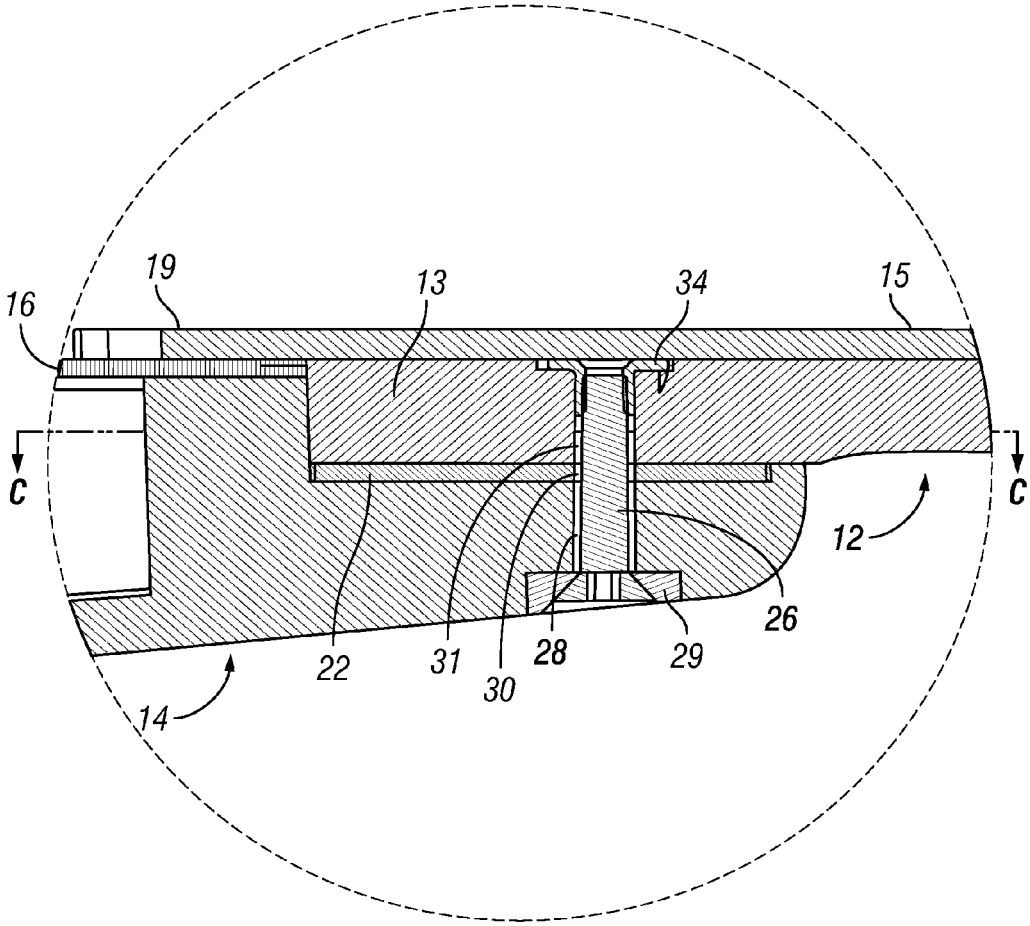
FIG. 4 is an enlarged cross-sectional view of section B of the musical instrument of FIG. 3.

Body 14 is a semi-solid guitar body that is solid adjacent pocket 20. Body 14 includes soundboard 16 that extends over the entire top surface of body 14 and at least partially encloses the cavities formed in the semi-solid body 14. Pocket 20 extends into the solid portion of body 14 as shown in FIGS. 3 and 4.

Spacers 22 are thin pieces of material each of which includes a perimeter that compliments the perimeter of pocket 20. As a result, the area of the surface of spacer 22 and the respective abutting surfaces of tongue 13 and pocket 20 are approximately equal. Contact between spacer 22 and the adjacent parts over that full surface area avoids gaps that could allow the fit of the neck joint to change over time. The complimenting perimeters result in spacer 22 closely fitting within pocket 20 and spacer 22 may include engagement features that engage the engagement features of pocket 20. In the present embodiment, spacer 22 is disposed within spacer well 21 which is formed in pocket 20 by spacer retaining wall 23. As a result, spacer 22 includes a perimeter that compliments pocket 20 and has a length in the direction of the longitudinal axis of neck 12 that allows it to fit within spacer well 21. Preferably, spacer 22 and spacer well 21 have approximately the same length so that spacer 22 completely fills spacer well 21. Spacers 22 are preferably laser-cut and machine-tapered in graduated increments of 0.002 inches so that small adjustments between neck 12 and body 14 may be easily made by substituting different sized spacers. Spacers 22 may be made of wood, plastic, metal or combinations of those materials. Preferably, one spacer is interposed between neck 12 and body 14 in an assembled instrument, but it should be appreciated that multiple spacers may be utilized to achieve a desired orientation of neck 12 with respect to body 14.

A fastener 26 is employed to prevent disconnection of neck 12 from body 14 in an assembled instrument. In the present embodiment, fastener 26 is a screw that passes through an aperture 28 in body 14, an aperture 30 in spacer 22 and an aperture 31 in tongue 13 and is threaded into a threaded insert 34 embedded in neck 12. Preferably the insert is embedded in neck 12 so that it is hidden from view between fingerboard 15 and tongue 13. However, it should be appreciated that insert 34 may be placed in neck 12 so that it is visible and insert 34 may be constructed so that it is ornamental. In addition, insert 34 may be installed in an aperture extending through fingerboard 15 and covered by a cover, which may also be ornamental.

Apertures 28, 30, 31 are located so that fastener 26 is oriented substantially normal to soundboard 16 and extends through the neck joint of musical instrument 10. Apertures 28, 30, 31 are offset so that a projection 46 in an end wall 42 of pocket 20 is forced into a recess 56 in end wall 52 of tongue 13 when fastener 26 is installed. For example, in the present embodiment, the center line of aperture 28 is offset by approximately 0.005 inches from the centerline of aperture 31 so that projection 46 is forced into engagement with recess 56 (i.e., end wall 52 of tongue 13 is pulled toward end wall 42 of pocket 20 when fastener 26 is tightened).

In the present embodiment, fastener 26 is a 5/16-18 flathead socket cap screw. It should be appreciated that any fastener may be included that provides sufficient strength to maintain neck 12 and body 14 coupled during use of musical instrument 10. As those skilled in the art will appreciate, the fastener could also be a threaded post attached to neck 12. In such an embodiment, when tongue 13 is engaged in pocket 20 of body 14, the threaded post would extend through body 14 and a nut would be threaded onto the threaded post. A recess could be provided in a back surface 18 of body 14 so that the post and nut are recessed into body 14. Optionally a cap engaging the recess may be used to cover the post and nut.

As shown in FIG. 4, in the present embodiment, a counterbore 32 is included at the external end of aperture 28 that is configured to receive an insert 29. Insert 29 is a tapered washer that engages a tapered head of fastener 26. Insert 29 may be dimensioned so that it fits snugly within counterbore 32 so that the engagement between the head of fastener 26 and insert 29 causes neck 12 and body 14 to be pulled towards each other as a result of the offset centerlines of apertures 28, 31. Counterbore 32 may also be dimensioned so that insert 29 and the head of fastener 26 are flush with bottom surface 18 of body 14. In a still further embodiment, insert 29 may be configured to mate with an ornamental cover (not shown) that hides the head of fastener 26 and improves the aesthetics of musical instrument 10.

Figure 5:
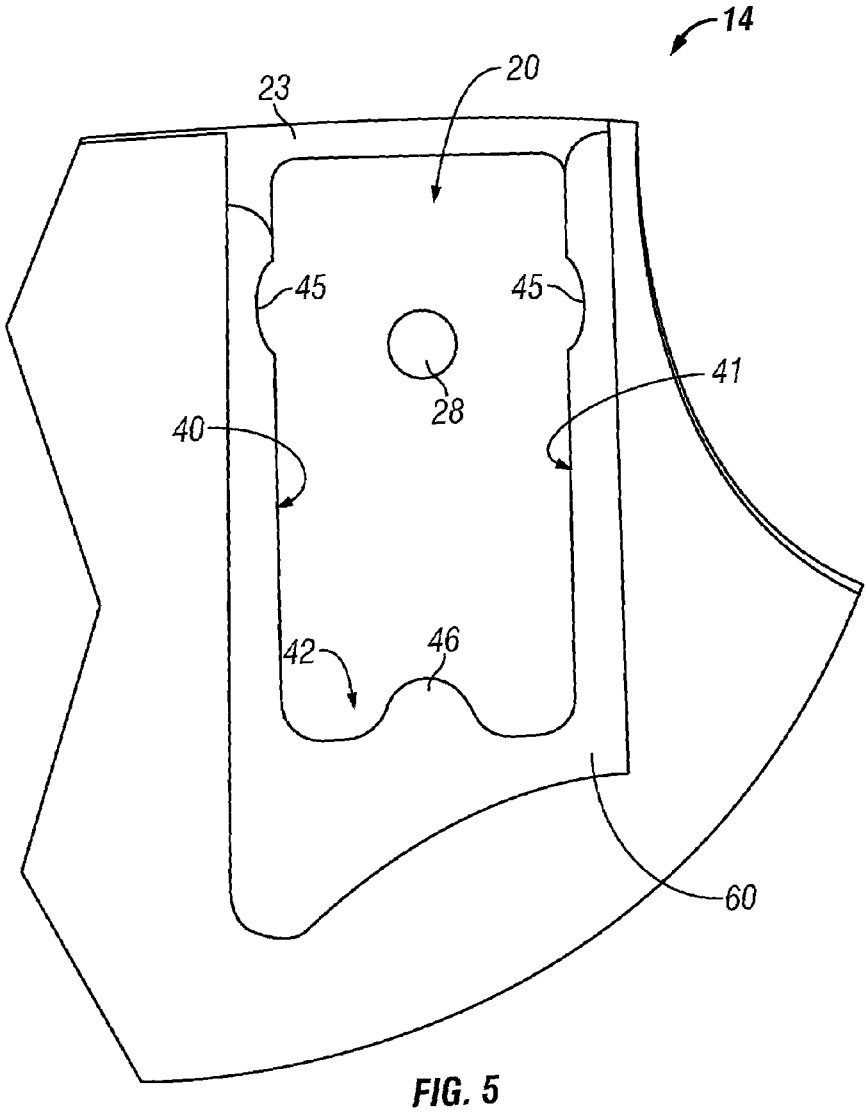
FIG. 5 is an enlarged front view of a portion of the body of the musical instrument of FIG. 1.

Referring to FIGS. 1 and 5, pocket 20 of body 14 will be described. Pocket 20 is generally an open ended recess that extends into body 14 from the top surface of soundboard 16. Pocket 20 includes a bottom surface 39, two sidewalls 40, 41, an end wall 42. Pocket 20 may also include a spacer retaining wall 23 that encloses spacer well 21. As shown, sidewalls 40, 41, end wall 42 and spacer retaining wall 23 extend generally perpendicularly from bottom surface 39 toward soundboard 16. Sidewalls 40, 41 and end wall 42 extend from bottom surface 39 to an outer surface of soundboard 16. Spacer retaining wall 23, however, extends from bottom surface 39 a distance that generally corresponds to the thickness of the adjacent end of spacer 22. As a result, when musical instrument 10 is assembled, spacer is generally enclosed between neck 12 and body 14, as shown in FIG. 4, and is hidden within spacer well 21.

Sidewalls 40,41 include engagement features, which in the present embodiment are recesses 45. Recesses 45 are generally arcuate indentations. For the purpose of illustration, recesses 45 are shown exaggerated in FIG. 5. It should be understood that recesses 45 may comprise slight indentations which may have a depth as little as 0.010 inches. It should be appreciated that recesses 45 may have any desired shape and need not be arcuate. For example, recesses 45 may be triangular, square or any other polygonal shape. It should further be understood that recesses 45 may be omitted if desired.

End wall 42 includes a projection 46 that extends toward the open end of pocket 20. Projection 46 extends from the remainder of end wall 42 approximately 0.20-0.50 inches. In the present embodiment, projection is arcuate, but it should be appreciated that projection may be any desired shape. For example, projection may be triangular, square or any other polygonal shape.

Soundboard 16 of body 12 may also include a recess 60 that is configured to receive tail portion 19 of fingerboard 15. Preferably, recess 60, spacer retaining wall 23, spacer 22 and tongue 13 are dimensioned so that when musical instrument 10 is assembled tail 19 rests within recess 60 and tongue 13 contacts spacer retaining wall 43. It should be appreciated that such a fit is preferred to provide an aesthetically pleasing interface between neck 12 and body 14.

Figure 6:
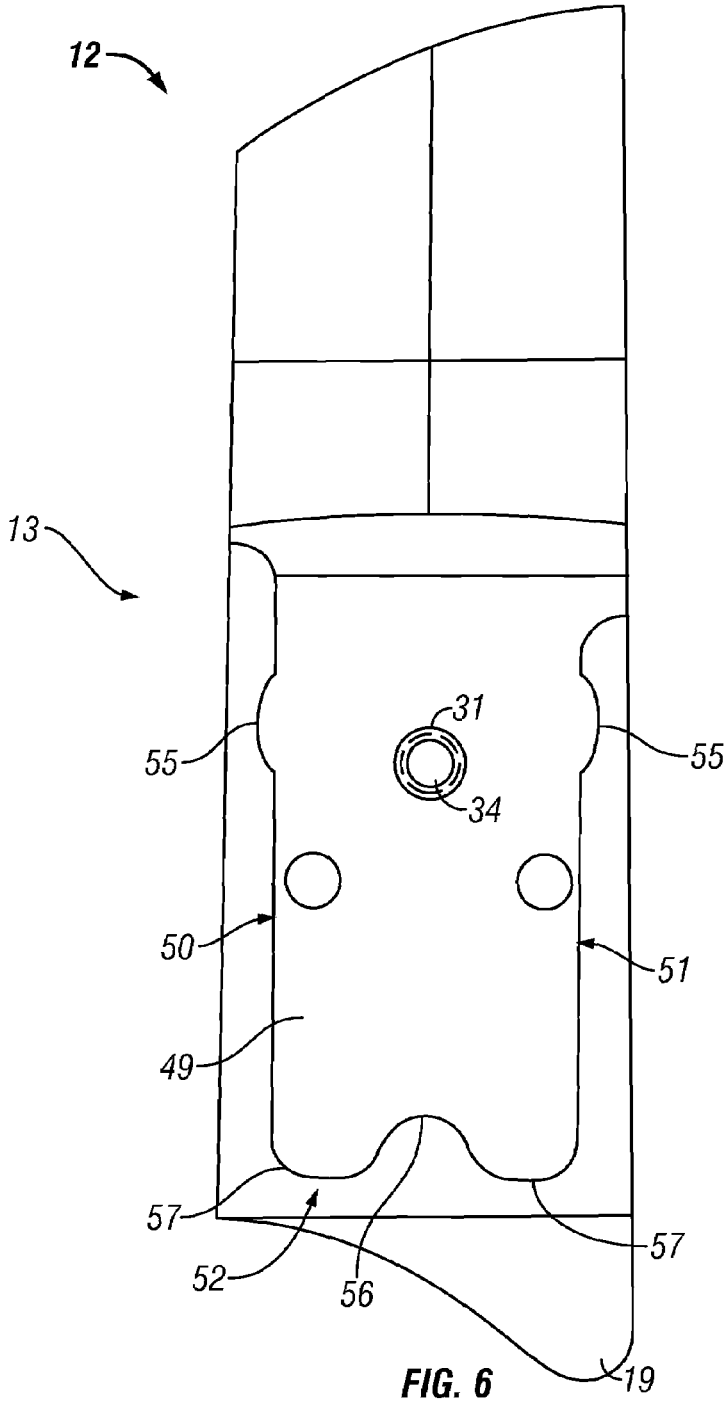
FIG. 6 is an enlarged rear view of a portion of the neck of the musical instrument of FIG. 1.

Referring to FIGS. 1 and 6, tongue 13 of neck 12 will be described. Tongue 13 is a portion of neck 12 that has a cross-sectional shape that generally matches the shape of pocket 20 so that tongue 13 may be inserted into pocket 20. Tongue 13 includes engagement features that are configured to engage corresponding engagement features of pocket 20 so that neck tongue 13 and pocket 20 are interlocked. The portions of tongue 13 other than the engagement features are dimensioned so that there is clearance between the walls of pocket 20 and the walls of tongue 13. As a result, the fit between tongue 13 and pocket 20 may be easily controlled by controlling the engagement features and the offset of apertures 28 and 31. Such a configuration eases manufacture of the neck 12 and body 14 because it avoids requiring tight control over tolerances for all the surfaces of tongue 13 and pocket 20. Instead tight tolerances are required only for the engagement features.

Tongue 13 includes a bottom surface 49, two side walls 50, 51 and an end wall 52. Projections 55 are engagement features that extend from sidewalls 50,51. Projections 55 are arcuate and extend laterally away from side walls 50,51 of tongue 13. However, projections 55 may be any shape desired, but it is preferred that they have a shape that compliments recesses 45 in sidewalls 40, 41 of pocket 20. End wall 52 of tongue 13 includes two convex curved portions 57 and a recess 56 therebetween.

Figure 7:
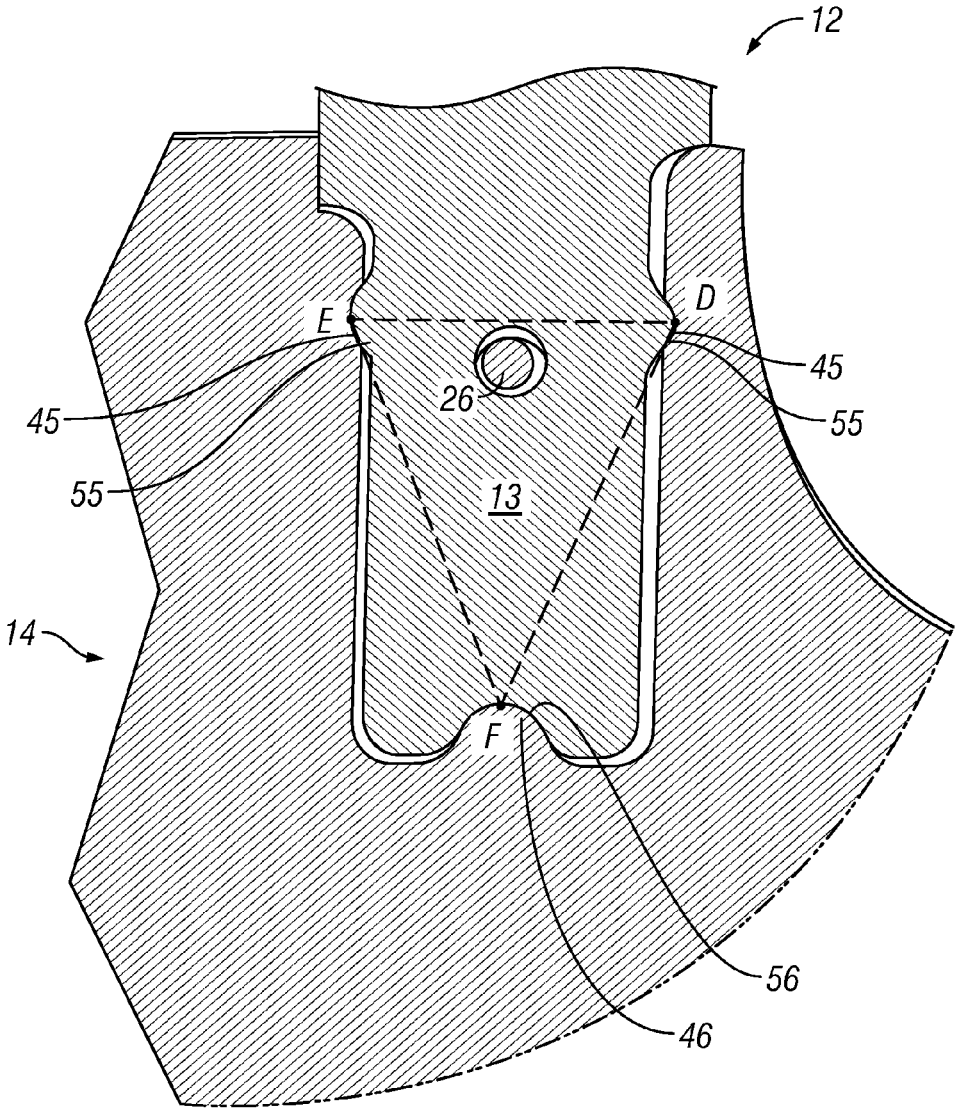
FIG. 7 is a cross-sectional view of the musical instrument of FIG. 4 taken along line C-C showing the interface between the neck and body, in accordance with the principles of the present invention.

FIG. 7 illustrates the fit between tongue 13 and pocket 20. As shown, engagement features of tongue 13 and pocket 20 contact at three locations D, E, F in the plane of the cross-section taken at Line C-C in FIG. 4. The engagement features of tongue 13 and pocket 20 are positioned so that locations D, E, F generally form apices of a triangle, as shown by phantom line. Preferably, the engagement mating of the corresponding engagement features prevents movement of tongue 13 relative to pocket in the plane of the cross-section. That triangulated contact between tongue 13 and pocket 20 efficiently restrains relative movement between neck 12 and body 14. In particular, engagement of projection 46 with recess 56 at location F prevents translation of tongue 13 toward end wall 42 and lateral translation of tongue 13 relative to pocket 20. Additionally, engagement between recesses 45 and projections 55 prevent translation of tongue 13 relative to pocket both along the longitudinal axis of neck 12 and laterally across pocket 20.

It should also be appreciated that because tail 19 of fingerboard 15 extends beyond the edges of tongue 13 and rests within recess 60 in the assembled musical instrument 10, any gap, or clearance, between tongue 13 and pocket 20 (such as that shown in FIG. 7) is not visible to a user. As a result, the manufacture and assembly of the neckjoint are simplified while the aesthetics of the instrument are maintained.

Figure 8:
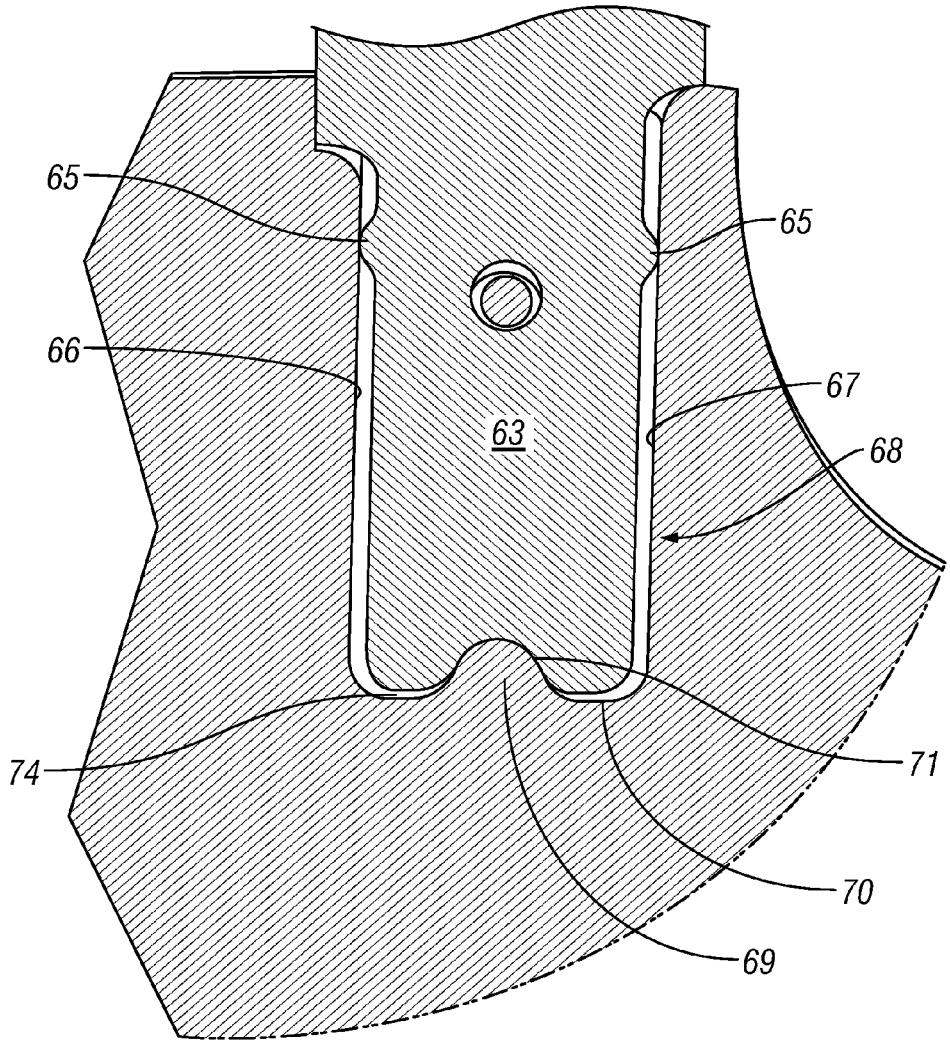
FIG. 8 is a cross-sectional view of an alternative embodiment of the musical instrument showing the interface between the neck and body.

Referring to FIG. 8, in another embodiment of the musical instrument, tongue 63 includes projections 65 that contact sidewalls 66, 67 of pocket 68 to prevent lateral movement of tongue 63 within pocket 68. However, no recesses are provided in side walls 66, 67 to receive projections 65. Tongue 63 also includes a recess 71 in end wall 74 that is configured to mate with an arcuate projection 69 in end wall 70 of pocket 68. In such an embodiment, an offset between the apertures extending through the body and the neck forces projection 69 to engage recess 71 of tongue 63 and to remain in contact. An advantage of such an embodiment is that the walls of pocket 68 have a shape that is easier to manufacture and the joint may be capable of allowing greater angular adjustment between the neck and body of the musical instrument.

Figure 9:
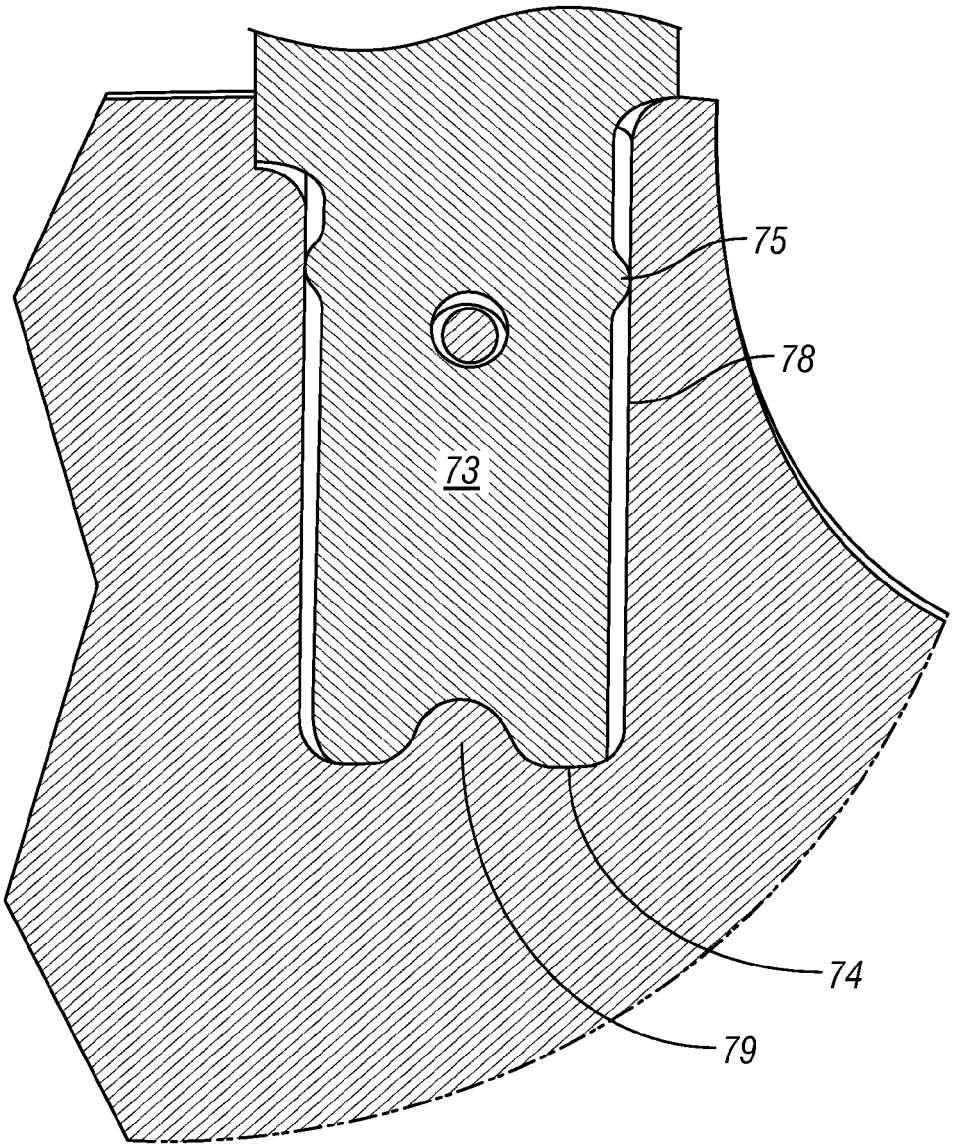
FIG. 9 is a cross-sectional view of another alternative embodiment of the musical instrument showing the interface between the neck and body.

Referring to FIG. 9, another embodiment of the musical instrument includes a tongue 73 that has an end wall 74 that is dimensioned so that substantially the entire end wall 74 engages an end wall of a pocket 78. It should be appreciated that the additional surface area contact between tongue 73 and pocket 78 further prevents relative motion between tongue 73 and pocket 78 by preventing tongue 73 from pivoting on projection 79. Tongue 73 also includes projections 75 that engage the sidewalls of pocket 78. However, it should be appreciated that recesses may also be included in the sidewalls of pocket 78 that are configured to receive projections 75 to further lock tongue 73 within pocket 78.

Figure 10:
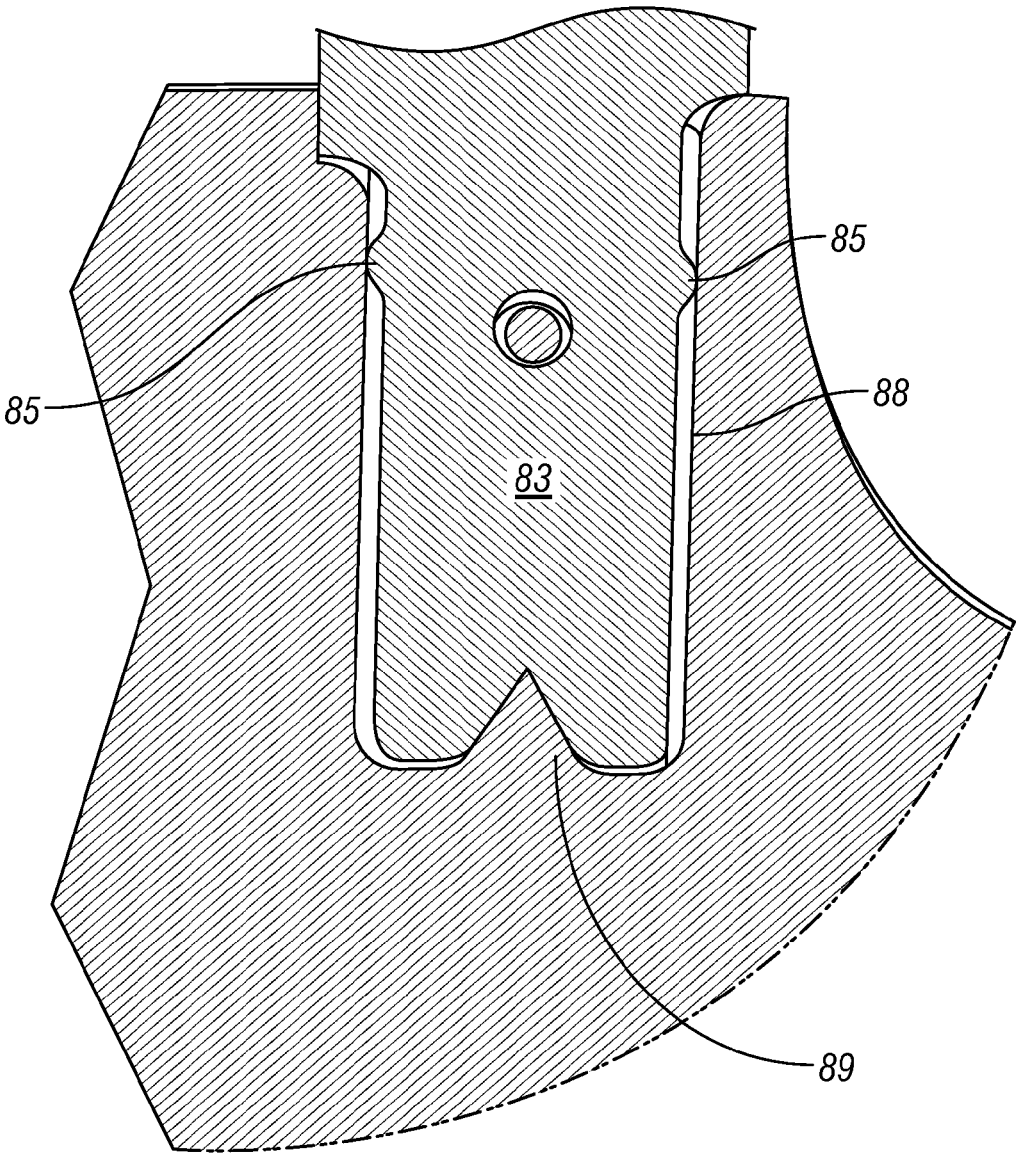
FIG. 10 is a cross-sectional view of a still further alternative embodiment of the musical instrument showing the interface between the neck and body.

As described above, the projection in the end wall of the pocket may have any shape. For example, as shown in FIG. 10, an alternative embodiment includes a tongue 83 that mates with a pocket 88 that includes an angular projection 89. Tongue 83 also includes projections 85 that engage the sidewalls of pocket 88. However, it should be appreciated that recesses may be included in the sidewalls of pocket 88 that are configured to receive projections 85 to further lock tongue 83 within pocket 88.

The dimensions of the engagement features of the tongue and pocket are selected to allow for a desired amount of angular adjustability between the neck and body of the musical instrument. It should be appreciated that the orientations of the projections and recesses included in the above-described embodiments are exemplary and the location of each projection and any associated recess may be reversed if desired. For example, instead of the tongue including a projection that mates with a recess in the side wall of the pocket, the pocket side wall may include a projection that mates with a recess in the tongue.

In the illustrated embodiments, the musical instrument comprises a guitar. However, as would be appreciated by those of ordinary skill in the art, the principles described herein may be applied to any musical instrument that includes a neck coupled to a body. For example, the principles may be applied to musical instruments other than guitars, such as basses, violins and cellos without departing from the scope of the present invention.

Thus, it is seen that musical instrument neck joint is provided. One skilled in the art will appreciate that the present invention can be practiced by other than the various embodiments and preferred embodiments, which are presented in this description for purposes of illustration and not of limitation, and the present invention is limited only by the claims that follow. It is noted that equivalents for the particular embodiments discussed in this description may practice the invention as well.

What is claimed is:

1. A musical instrument including a neck joint, comprising:

a body including a pocket defined at least in part by two opposing sidewalls and an end wall connecting the two sidewalls;

a projection extending from the end wall;

a neck including a mounting portion including a recess sized to receive the projection; and a fastener that couples the neck to the body, wherein the body and neck are coupled such that the projection is received in and abuts the recess.

2. The musical instrument of claim 1, wherein the mounting portion includes a pair of second projections, wherein each second projection is configured to abut one of the sidewalls of the pocket.

3. The musical instrument of claim 2, wherein the pocket includes a pair of recesses disposed in the sidewalls of the pocket that are configured to receive the second projections.

4. The musical instrument of claim 1, further comprising a spacer that is interposed between the neck and the body within the pocket, wherein the spacer has a perimeter that compliments the perimeter of the pocket.

5. The musical instrument of claim 4, wherein the pocket includes a spacer well and the spacer has a length that substantially corresponds to the length of the spacer well so that the spacer substantially fills the spacer well.

6. The musical instrument of claim 4, wherein the spacer is wedge-shaped.

7. The musical instrument of claim 4, wherein the spacer includes a recess that is configured to receive the projection of the pocket.

8. The musical instrument of claim 4, wherein the spacer includes a pair of projections extending laterally outward from the sidewalls of the spacer.

9. The musical instrument of claim 1, wherein the fastener is a threaded screw that extends through the body and is coupled to a threaded nut that is coupled to the neck.

10. The musical instrument of claim 1, wherein the body includes a recess that extends into the bottom surface of the body that is configured to receive a head portion of the fastener.

11. The musical instrument of claim 10, further comprising an insert configured to receive the head portion of the fastener, wherein the insert is received within the recess in the body.

12. The musical instrument of claim 1, wherein the abutment surface of the projection is arcuate.

13. The musical instrument of claim 1, wherein the abutment surface of the projection includes a plurality of planar surfaces.

14. The musical instrument of claim 1, wherein the fastener is spaced from the projection of the pocket along a longitudinal axis of the neck in the direction of a head end of the neck.

15. A musical instrument, comprising:

a body including a pocket defined at least in part by two opposing sidewalls and an end wall connecting the two sidewalls;

wherein the pocket includes a first engagement feature on the end wall;

a neck including a tongue, wherein the tongue includes a second engagement feature on an end wall thereof that has a shape that is complimentary to the first engagement feature; and a fastener that couples the neck to the body such that the first engagement feature abuts the second engagement feature.

16. The musical instrument of claim 15, wherein the first engagement feature is a recess and the second engagement feature is a projection.

17. The musical instrument of claim 15, wherein the tongue includes a pair of second projections, wherein each projection extends from a side wall of the tongue and is configured to abut the sidewall of the pocket.

18. The musical instrument of claim 17, wherein the pocket includes a pair of recesses disposed in the sidewalls of the pocket that are configured to receive the pair of second projections.

19. A musical instrument including a neck joint, comprising:

a body including a pocket having three alignment features;

a neck including a mounting portion having three alignment features corresponding to the three alignment features in the pocket; and a fastener that couples the neck to the body such that the corresponding alignment features of the pocket and mounting portion abut each other, wherein the alignment features are configured such that there are triangulated locations of contact between the end wall and sidewalls of the pocket and the mounting portion.

20. The musical instrument of claim 19, wherein the fastener is a single fastener that is located within a triangle formed between the triangulated locations of contact.

* * * * *